US005990918A

United States Patent [19]

Baxendale

[11] Patent Number: 5,990,918

[45] Date of Patent: Nov. 23, 1999

[54] IMAGING METHOD USING DEPOSITION OF DOTS OF PLASTIC TO FORM A RELIEF IMAGE

[75] Inventor: John Edward Baxendale, Ferndown, United Kingdom

[73] Assignee: Ultra Electronics Limited, Middlesex, United Kingdom

[21] Appl. No.: 08/930,050

[22] PCT Filed: Mar. 25, 1996

[86] PCT No.: PCT/GB96/00707

§ 371 Date: Sep. 26, 1997

§ 102(e) Date: Sep. 26, 1997

[87] PCT Pub. No.: WO96/30215

PCT Pub. Date: Oct. 3, 1996

[30] Foreign Application Priority Data

Mar. 27, 1995 [GB] United Kingdom ..... 9506214

[51] Int. Cl.[6] ..... B41J 2/32

[52] U.S. Cl. ..... 347/212; 347/171

[58] Field of Search ..... 347/171, 212; 400/120.18, 120.01

[56] References Cited

U.S. PATENT DOCUMENTS 5,387,573 2/1995 Oldfield et al. ..... 503/227

FOREIGN PATENT DOCUMENTS 0407615 1/1991 European Pat. Off. .

OTHER PUBLICATIONS

Ohya et al., "Gray–Scale Printing on Plain Paper Using Thermal Ink—Transfer Imaging", Journal of Imaging Technology, vol. 10, No. 2, Apr. 1984 pp. 57–63.

*Primary Examiner*—Huan Tran
*Attorney, Agent, or Firm*—Marshall, O'Toole, Gerstein, Murray & Borun

[57] ABSTRACT

A method of forming an image comprises depositing pixels or dots of a plastic material of different thickness or texture on a surface so as to form a relief or textured image in the surface. The plastic material can be transferred to the surface by thermal transfer from a carrier film.

16 Claims, 2 Drawing Sheets

IMAGING METHOD USING DEPOSITION OF DOTS OF PLASTIC TO FORM A RELIEF IMAGE

BACKGROUND OF THE INVENTION

This invention relates to a method and apparatus for forming an image on a surface, and articles on which such images have been formed.

Thermal transfer printing is a well known printing technique, whereby a dye, resin wax or similar transferable pigments are transferred from a thin carrier film to a receiver media by means of thermal impulses from a thermal array printhead. The pigments may be any colour but are commonly black, yellow, cyan or magenta.

In this process, the thermal array printhead comprises a linear array of several hundred small heater elements, in intimate contact with the carrier film, the pigmented surface of which is pressed against the receiver media.

When selected heater elements on the surface of the thermal printhead are given short pulses of electrical energy, this raises their surface temperature to a value where pigment is transferred from the carrier film to the receiver media to form a pixel or coloured spot on the receiver media. Following this transfer, the carrier film and receiver film are moved relative to the thermal printhead, by a distance equivalent to the diameter of the spot. By a process of repeating this sequence of heat impulses followed by media movement, any desired image is built up. The cycle times for printing a linear array of pixels or colour spots is generally five milliseconds or less. Half tone images are produced by printing a dither pattern of dots and spaces. True photographic quality images are produced by controlling the energies of the heat impulses in conjunction with a suitable diffusion type of dye film. This type of printing is known as dye sublimation or dye diffusion printing.

In certain applications, such as the printing of colour images onto PVC cards for identity purposes, it is necessary to protect the images from damage due to abrasion and wear. The most common method is for a thin, transparent plastic coating to be applied to the printing media. A special plastic overlay film is used, which consists of a thin carrier film coated with a layer of a clear plastic material. The said material may be transferred to the top surface of the printed receiver media by means of a heated roller, or by means of a thermal printhead, in the same manner as the pigment layer is transferred as described above. Essentially all of the plastic material is transferred to the surface of the receiver media, which results in a glossy finish protective overlay, of maximum thickness, to protect the underlying image.

BRIEF SUMMARY OF THE INVENTION

According to the present invention an image is formed as a relief or textured image on a surface by depositing pixels or dots of plastics material of differing thickness or texture on said surface.

In particular a method of forming an image on a surface according to the invention consists in using a thermal printhead with multiple heater elements, and a carrier film coated with a layer of plastics material, the heating elements serving to heat the carrier film with the plastics coating in contact with said surface so that the plastics material is transferred to said surface in those areas adjacent to energised heater elements. The heater elements may be energised selectively so that they conduct or attain different levels of heat and cause a variation in the thickness of plastics material transferred to said surface at different points. It is thus possible to produce a desired surface pattern in the form of a relief image.

The heater elements may be energised so that the plastics material is applied as a continuous layer over the whole of an area to be coated, and may serve as a protective coating.

Energisation of the heater elements may be controlled continuously or discretely over a range of energy levels to produce a coating that varies continuously or discretely in thickness over said surface. In one example, each heater element may be energised at one or the other of two energy levels so as to transfer either a maximum thickness or a lesser thickness, nominally 50% of the plastics material, from the carrier film to said surface.

The plastics material may be a clear plastics material so that another image, such as a printed image, on said surface is visible through the coating. An example might be a clear plastics coating on a plastics identity card or bank/credit card, with the relief image serving as an additional authentication feature.

The relief image is most clearly seen in reflected light from a discrete source. An image reading head operating on the basis of reflected light may be provided to read the relief image, typically, if used in an automated image authentication process.

If all of the plastics material in a particular area is transferred from the carrier film to said surface, then the exposed surface of the plastics material will tend to be smooth and shiny compared with the exposed surface of a thinner layer of transferred plastics material, which will be more textured or have a satin appearance.

In an alternative arrangement, the full depth of the plastics material may be transferred for each pixel but selected pixels may then be overheated, thereby giving them a matt or satin appearance, whereas the other areas of the plastics material are smooth and shiny.

The carrier film carrying the plastics material is preferably moved relative to the thermal printhead so as to progressively form the relief image in a similar manner to that when printing the image in the known thermal transfer printing process. If the relief image is applied to a surface carrying an image printed by the thermal transfer process, then the printed image and relief image may be formed in successive steps in a continuous printing process.

Either two separate printheads, may be used, one for each image, or a single common printhead may be used to form both images. In the latter case, the carrier film may carry both the plastics material and the print pigment in successive areas in the feed direction of the film.

BRIEF DESCRIPTION OF THE DRAWINGS

The invention is illustrated in the accompanying drawings in which.

DETAILED DESCRIPTION OF THE INVENTION

Figure 1:
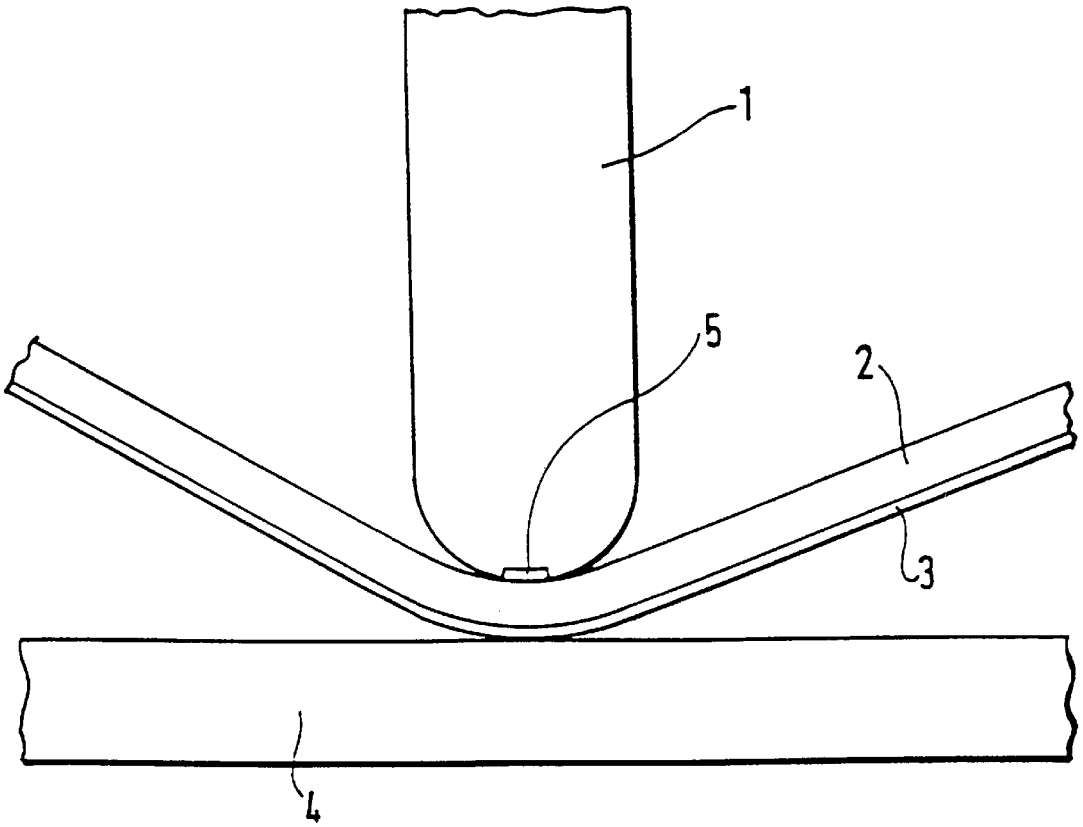
FIG. 1 is a cross-section of a thermal array printhead as used according to the invention.
Figure 2:
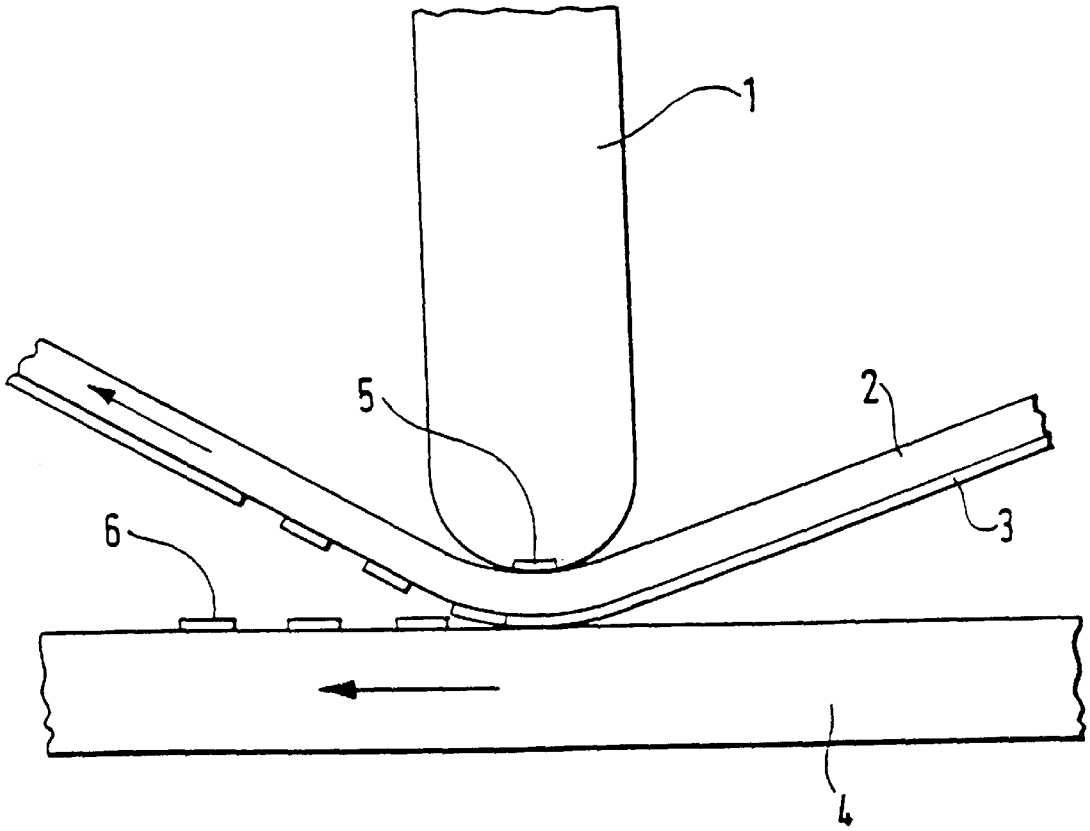
FIG. 2 illustrates how the printhead of FIG. 1 prints an image by depositing pigment on a receiver surface.

As shown in FIGS. 1 and 2, the thermal printhead 1 is in intimate contact with the carrier film 2 and the pigment 3 on the surface of the film is pressed against the receiver layer 4. The carrier film 2 and receiver layer 4 are moved together relative to the printhead 1, and the heater elements 5 aligned along the printhead are selectively energised by electrical pulses to transfer dots or pixels 6 of pigment to the receiver layer 4 in successive lateral rows across the width of the receiver layer.

Figure 3:
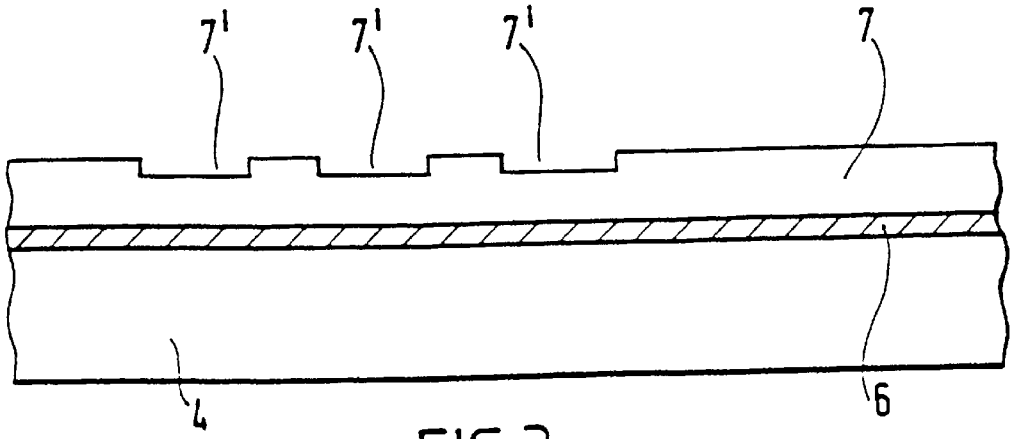
FIG. 3 is a cross-section of the printed receiver surface of FIG. 2 with a protective plastics coating applied to it incorporating a relief image according to the invention.

In a subsequent plastics coating process, which could involve the same printhead 1 or a separate similar printhead, a coating of clear plastics material 7 is transferred to the pigment layer 6 (shown in FIG. 3) from a carrier film which passes beneath the printhead with the receiver layer 4 in a similar manner to that shown in FIG. 2. Again, the heater elements 5 of the printhead are selectively energised so as to transfer pixels or dots of the plastics material 7 of different thickness to the receiver layer 4 in a continuous manner so that the whole of the pigment layer 6 is coated. Every heater element 5 is energised to form each successive row of pixels or dots of plastics material but each heater element is energised at either of two different levels so as to transfer either the whole thickness of the plastics material or only part of the thickness of the plastics film, typically 50%, from the carrier film to the receiver layer. The pattern of the thinner pixels or dots 7' as shown in FIG. 3 is determined by a controller controlling energisation of the heater elements, and corresponds to the image that is required to be formed as a relief image in the final plastics coating.

Figure 4:
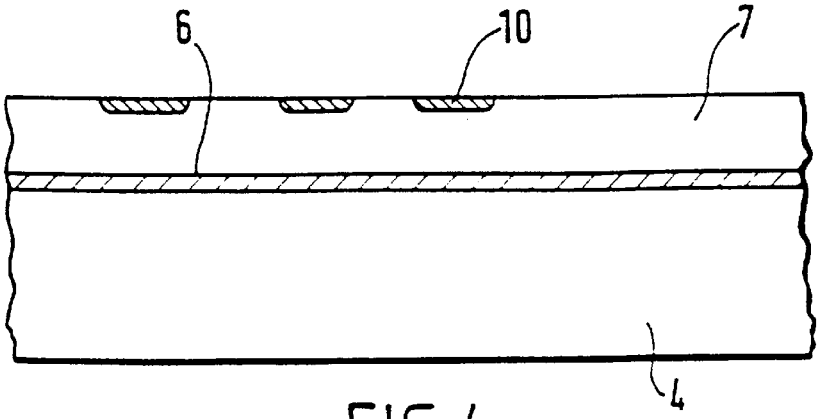
FIG. 4 is a cross-section of the printed receiver surface of FIG. 2 with a protective plastics coating applied to it incorporating a texture image according to the invention.

FIG. 4 illustrates an alternative embodiment of the present invention. In this arrangement, the heater elements of the print head 5 are controlled between a first and a second heating value. Each heating value causes the entirety of the coating of plastics material 7 to be transferred from the carrier film to the receiver layer 4. However, the first heating value is greater than the second heater value, and the additional heating overworks the clear plastics material and damages its shiny upper layer in order to create regions 10 which are not shiny and may have a matt or satin-like appearance. Thus, a uniformly thick protective layer bearing an image can be deposited onto the receiver layer, and hence over any images printed thereon.

We claim:

1. A method of forming an image, comprising the steps of thermally depositing a layer of plastics material onto a surface and over heating selected portions of the material so as to form an image therein, wherein during said step of thermally depositing the plastic, the full thickness of the plastics material is deposited on the surface with selected pixels being over heated so as to give the selected pixels a matt appearance.

2. A method as claimed in claim 1, wherein the step of thermally depositing the layer of plastics material onto the surface further comprises the steps of providing a carrier film with a layer of the plastics material, providing a plurality of heater elements on a thermal printhead and heating the carrier film with the plastics material in contact with the surface so that the plastics material is deposited onto the surface in those areas adjacent to energized heater elements.

3. A method as claimed in claim 2, wherein the step of energising the heater elements deposits a continuous layer of the plastics material over the whole of an area to be coated, such that the plastics material serves as a protective coating.

4. A method as claimed in claim 2, wherein during the step of thermally depositing the layer of plastics the carrier film is progressively advanced with respect to the printhead during the printing process.

5. A method as claimed in claim 1, wherein the plastics material is clear so that another image on the surface is visible through the plastics material deposited on the surface.

6. A surface on which a first image has been formed in accordance with the method of claim 1.

7. A surface as claimed in claim 6, wherein a second image is printed onto the surface prior to forming the first image.

8. An identity card on which an image has been formed in accordance with the method of claim 1.

9. A method of forming an image, comprising the steps of thermally depositing a layer of plastics material onto a surface and over heating selected portions of the material so as to form an image therein, wherein during the step of thermally depositing the layer of plastics, the full thickness of the plastics material is deposited on the surface with selected pixels being overheated so as to give the selected pixels a satin appearance.

10. A method as claimed in claim 9, wherein the step of thermally depositing the layer of plastics material onto the surface further comprises the steps of providing a carrier film with a layer of the plastics material, providing a plurality of heater elements on a thermal printhead and heating the carrier film with the plastics material in contact with the surface so that the plastics material is deposited onto the surface in those areas adjacent to energized heater elements.

11. A method as claimed in claim 10, wherein the step of energising the heater elements deposits a continuous layer of the plastics material over the whole of an area to be coated, such that the plastics material serves as a protective coating.

12. A method as claimed in claim 10, wherein during the step of thermally depositing the layer of plastics the carrier film is progressively advanced with respect to the printhead during the printing process.

13. A method as claimed in claim 9, wherein the plastics material is clear so that another image on the surface is visible through the plastics material deposited on the surface.

14. A surface on which a first image has been formed in accordance with the method of claim 9.

15. A surface as claimed in claim 14, wherein a second image is printed onto the surface prior to forming the first image.

16. An identity card on which an image has been formed in accordance with the method of claim 9.

* * * * *